US005964200A

United States Patent [19]

Shimada et al.

[11] Patent Number: 5,964,200

[45] Date of Patent: Oct. 12, 1999

[54] CONTROL APPARATUS AND CONTROL METHOD FOR LEAN BURN ENGINE AND ENGINE SYSTEM

[75] Inventors: Kousaku Shimada; Takeshi Atago, both of Hitachinaka, Japan

[73] Assignee: Hitachi, Ltd., Japan

[21] Appl. No.: 08/889,089

[22] Filed: Jul. 7, 1997

[30] Foreign Application Priority Data

Jul. 5, 1996 [JP] Japan ..... 8-176211

[51] Int. Cl.[6] ..... F02D 41/14; F02D 25/08

[52] U.S. Cl. ..... 123/305; 123/306; 123/399; 123/486; 123/568.21; 123/674

[58] Field of Search ..... 123/295, 305, 123/306, 399, 478, 480, 486, 568.21, 674

[56] References Cited

U.S. PATENT DOCUMENTS 5,190,008 3/1993 Yamasaki et al. ..... 123/486 X
5,363,826 11/1994 Takaoka ..... 123/486
5,447,137 9/1995 Asano et al. ..... 123/436

FOREIGN PATENT DOCUMENTS 2-85843 7/1990 Japan .
6-129276 5/1994 Japan .

*Primary Examiner*—Tony M. Argenbright
*Attorney, Agent, or Firm*—Evenson, McKeown, Edwards & Lenahan, P.L.L.C.

[57] ABSTRACT

An electronic engine control system for a lean burn engine includes a unit for detecting an amount Qa of intake air fed into a cylinder of the engine, a unit for detecting an engine speed Ne, a unit for calculating a basic fuel injection pulse width TPbas on the basis of the intake air amount Qa and the engine speed Ne, and a unit for determining control parameters containing any of at least an air-fuel ratio, an ignition timing, a fuel injection timing, a throttle opening and an EGR rate in accordance with an operating state of the engine in optimum. A reference TPref having the same dimension as the basic fuel injection pulse width TPbas and which is a function of an accelerator operating amount determined on the basis of the accelerator operating amount is determined as a load parameter used upon determination of the control parameters of the engine in operation with a lean air-fuel ratio.

20 Claims, 15 Drawing Sheets

FIG. 8

| TORQUE | T1 [8kgfm] | < | T2 [10kgfm] | < | T3 [12kgfm] | |
|---|---|---|---|---|---|---|
| REFERENCE TPref IN STOICHIOMETRIC | Tp1 [2.8] | a TIMES → [1.21 TIMES] ↗ | Tp2 [3.4] | → [1.12 TIMES] ↗ | Tp3 [3.8] | |
| TARGET A / F | A/F1 [28] | b TIMES → [0.86 TIMES] ↘ | A/F2 [24] | → [0.83 TIMES] ↘ | A/F3 [20] | A / F SET PATTERN 1 |
| ACTUAL TPact IN LEAN | LTp1 [5.33] | a×b TIMES → [1.04 TIMES] ↗ | LTp2 [5.55] | → [0.93 TIMES] ↘ | LTp3 [5.17] | |
| TARGET A / F | A/F1 [24] | b TIMES → [0.92 TIMES] ↘ | A/F2 [22] | → [0.91 TIMES] ↘ | A/F3 [20] | A / F SET PATTERN 2 |
| ACTUAL TPact IN LEAN | LTp1 [4.57] | a×b TIMES → [1.11 TIMES] ↗ | LTp2 [5.09] | → [1.02 TIMES] ↗ | LTp3 [5.17] | |

| ACCELERATOR OPERATING AMOUNT Acc (deg) | · · · | 4 | 8 | · · · |
|---|---|---|---|---|
| REFERENCE TPref (ms) | · · · | 2.31 | 2.52 | · · · |

CONTROL APPARATUS AND CONTROL METHOD FOR LEAN BURN ENGINE AND ENGINE SYSTEM

BACKGROUND OF THE INVENTION

The present invention relates to an electronic engine control system for a lean burn engine and more particularly to an engine control apparatus capable of retrieving an optimum control parameter in accordance with an engine condition even if a dynamic range of a air-fuel ratio to be controlled is wide to control the engine.

In a conventional engine control apparatus, generally, control parameters such as a target air-fuel ratio, a target throttle opening and an ignition timing are determined from a two-dimensional data map having one axis in which an engine speed Ne is defined and the other axis in which a basic injection amount (injection time) TPbas calculated from the engine speed Ne and an actually measured intake air amount Qa is defined as described in JP-U-2-85843. Further, as a special example, as described in JP-A-6-129276, the control parameters are determined from a two-dimensional data map having one axis in which an engine speed is defined and the other axis in which a target torque calculated from an acceleration opening is defined.

The lean burn system functions to increase the combustion efficiency so as to effectively utilize energy contained in fuel so that the fuel consumption is improved. When the air-fuel ratio is set to be leaner than the theoretical air-fuel ratio, the fuel consumption rate is improved, although since the combustion is made unstable, various measures have been made for the drivability and the exhaust emission control.

Further, in the lean combustion, when the air-fuel ratio exceeds a certain value, the combustion is unstable and variation of torque is suddenly increased, so that the smooth driving is difficult. For this purpose, there has been proposed that accurate control of the air-fuel ratio is made in the lean area in order to suppress the variation of torque to an allowable value.

The above-mentioned two known examples of the method of setting the control parameters are now verified in the lean burn engine represented by an inner-cylinder injection engine in which the dynamic range of the air-fuel ratio to be controlled is wide.

In the calculation method of the control parameters described in JP-U-2-85843, if it is assumed that the air-fuel ratio is controlled to be fixed in all of the operation area, the intake air amount Qa is increased as a load is increased. Accordingly, since the basic injection amount TPbas is increased monotonously and corresponds to the torque in one-to-one manner, the control parameters can be set to the optimum value even for any torque if the basic injection amount TPbas is used in the control axis.

However, when the air-fuel ratio for a light load condition is set to be leaner than the air-fuel ratio for a heavy load condition, the intake air amount Qa is reduced as the load is increased and even when the load is heavy, there is an area where the basic injection amount TPbas is reduced. Accordingly, the basic injection amount TPbas does not correspond to the torque in one-to-one manner. Hence, when the basic injection amount TPbas is used in the control axis, the control parameters cannot be set to the optimum value for any torque. Further, the basic injection amount TPbas representing the load is desirably increased as the load is increased, while since there occurs the reverse phenomenon that even when the load is increased the basic injection amount TPbas is the same or even when the load is increased the basic injection amount TPbas is reduced, the control is remarkably unstable. Since the phenomenon appears remarkably as a difference for the set air-fuel ratio is large, the control is not materialized in the lean burn engine represented by the inner-cylinder injection engine having a wide dynamic range of the air-fuel ratio to be controlled.

Furthermore, in JP-A-6-129276, the control parameters are retrieved from the data map having one axis in which the engine speed is defined and the other axis in which the target torque calculated from the acceleration opening is defined, while it cannot be verified whether the actual torque meets the target torque or not. Accordingly, even if the optimum values of the control parameters are set for respective torques in the bench test using a dynamometer, a deviation between the actual torque and the target torque cannot be compensated in an actual vehicle which cannot obtain the actual torque and accordingly the optimum control parameters cannot be retrieved from the map.

SUMMARY OF THE INVENTION

It is an object of the present invention to provide an engine control apparatus capable of setting the optimum values of control parameters to correspond to any torque in one-to-one manner even in the lean burn engine having a wide dynamic range of the air-fuel ratio to be controlled and exactly calculating the optimum values of control parameters for any torque even when the apparatus is actually mounted in a vehicle to attain the lean combustion stably.

In an embodiment of the present invention, a reference injection time TPref as a function of the accelerator operating amount is calculated. This reference TPref corresponds to a value of the basic fuel injection amount TPbas in the case where an engine is operated at a stoichiometric air-fuel ratio (A/F=14.7) in order to produce a certain torque and corresponds to the torque in one-to-one manner.

$$\text{Basic Fuel Injection Amount TPbas}=K\times Qa/Ne \quad (1)$$

$$\text{Reference TPref}=f\,(Ne,\ Acc) \quad (2)$$

where K is a coefficient, Ne an engine speed, Qa an intake air amount, and Acc an accelerator operating (depressing) amount.

Further, the reference TPref is updated by learning an actual basic fuel injection amount TPact while using two variables of the accelerator operating amount and the engine speed as axes in the ideal air-fuel ratio operation.

In the lean combustion, there is a relation that the actually measured basic fuel injection amount TPbas (hereinafter referred to as the actual TPact) is increased as the air-fuel ratio is lean even when the same torque is produced and the actual TPact does not correspond to the torque in one-to-one manner.

Thus, in the lean combustion, an operating point of the engine is determined in the map of the reference TPref and the engine speed Ne and the control parameters are retrieved to thereby determine the engine operating point uniquely regardless of the air-fuel ratio.

BRIEF DESCRIPTION OF THE DRAWINGS

FIG. 8 shows an example of setting of target air-fuel ratios for a plurality of different torque points;

DESCRIPTION OF THE PREFERRED EMBODIMENTS

An engine control unit according to the present invention is now described in detail with reference to embodiments shown in the accompanying drawings.

Figure 1A:
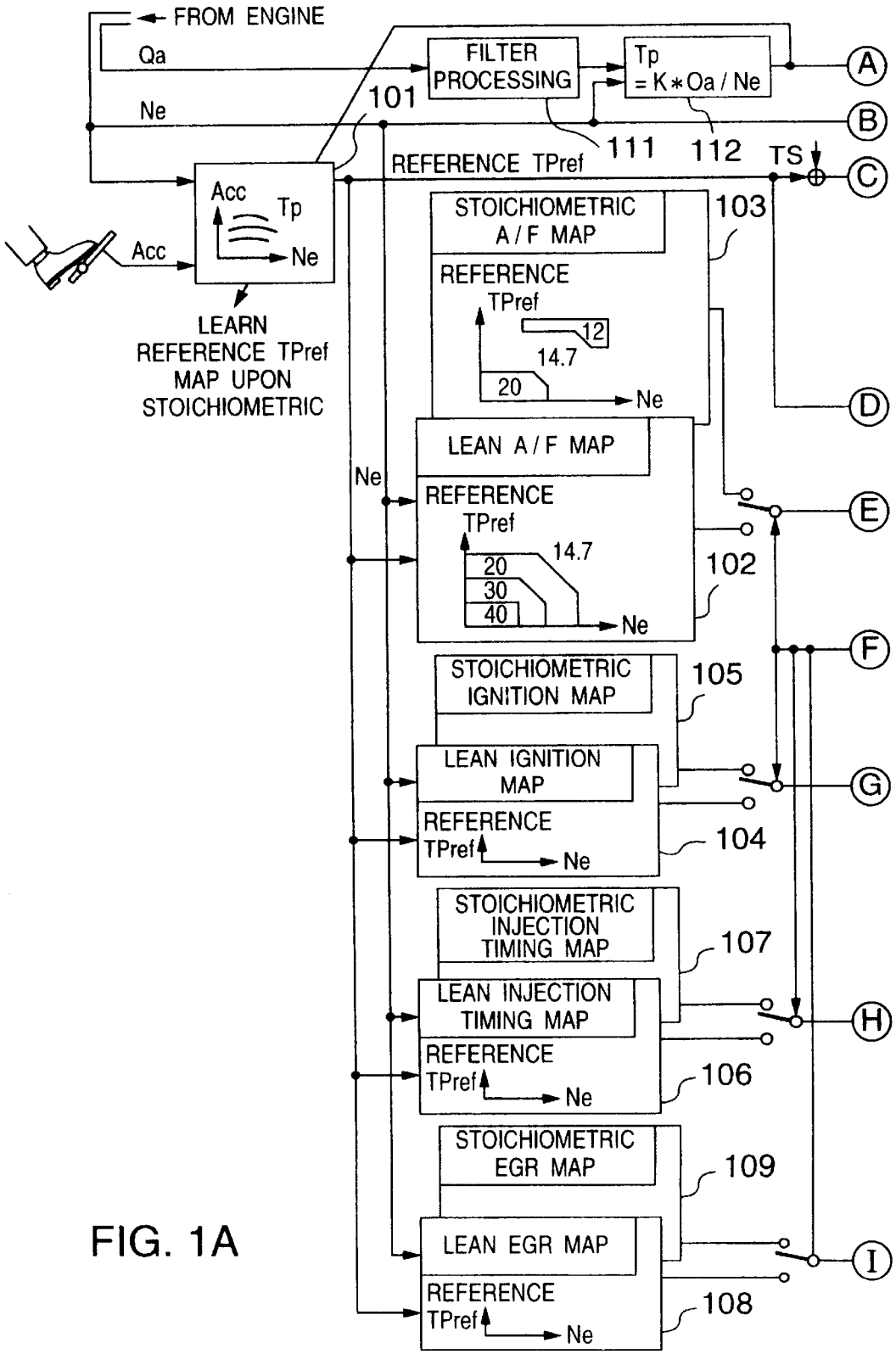
FIGS. 1A and 1B show a block diagram schematically illustrating the whole configuration of a control apparatus of a lean burn engine according to an embodiment of the present invention.
Figure 1B:
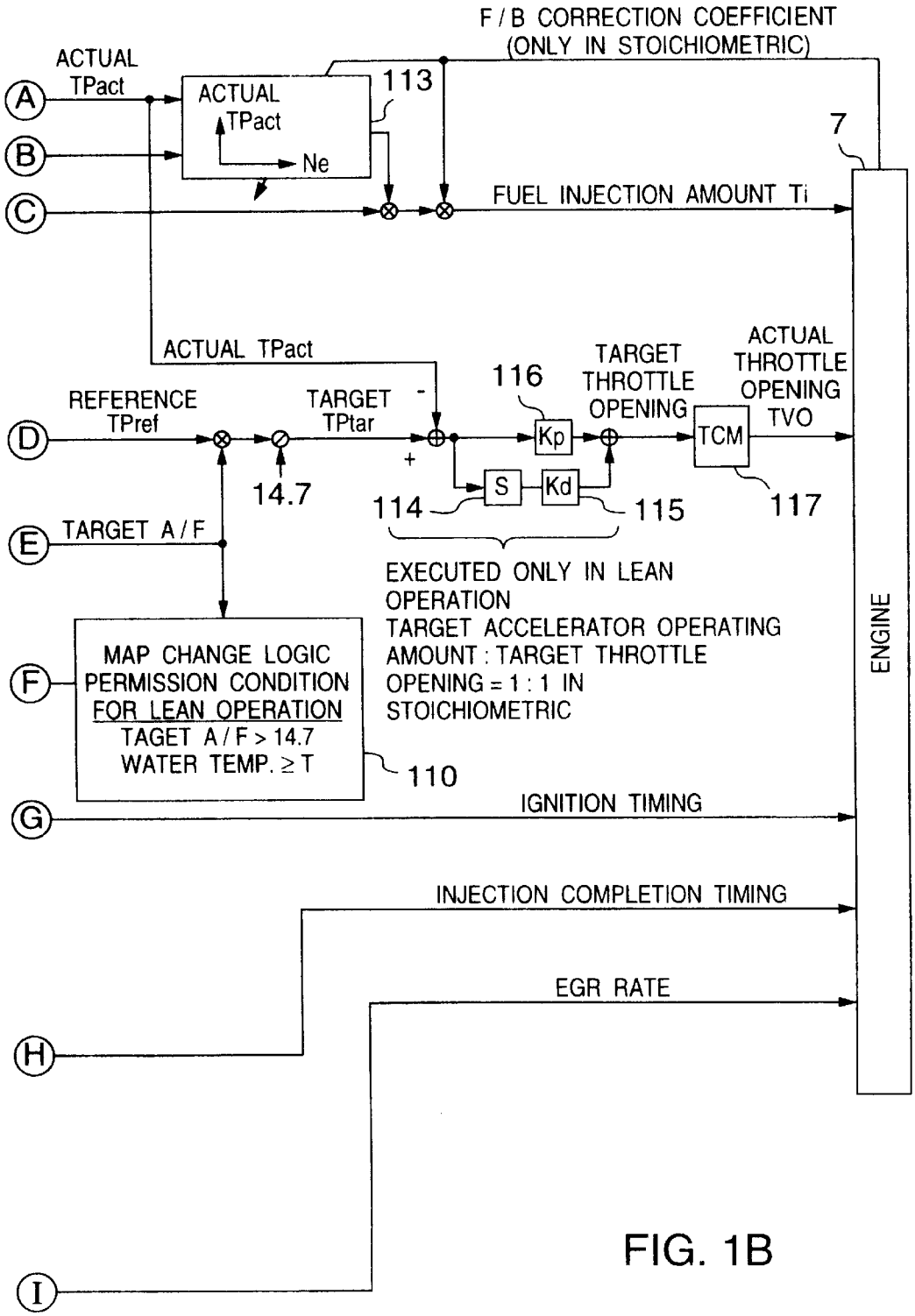

FIG. 1 is a block diagram schematically illustrating the whole configuration of a control unit of the present invention. A reference TPref map 101 is a map for obtaining a reference TPref from two variables of an accelerator operating amount Acc and an engine speed Ne. Values in the map can be updated by the actual TPact in the case of the theoretical air-fuel ratio (hereinafter referred to as "stoichiometric air-fuel ratio"). Since the combustion is made with the optimum values of the control parameters in accordance with the load and the speed of the engine, the maps for the air-fuel ratio, the ignition timing, the fuel injection timing and the EGR rate are retrieved by two variables of the engine speed Ne and the reference TPref. The air-fuel ratio is divided into a stoichiometric A/F (air-fuel ratio) map 103 and a lean A/F map 102 in the lean air-fuel ratio, the ignition timing is divided into a stoichiometric ignition map 105 and a lean ignition map 104, the fuel injection timing is divided into a stoichiometric injection timing map 107 and a lean injection timing map 106, and the EGR rate is divided into a stoichiometric EGR map 109 and a lean EGR map 108. Which of the stoichiometric map and the lean map is used in each of the maps is determined by a map changing logic 110.

A map changing logic 110 allows to use the maps on the lean side of the maps for the control parameters when the target air-fuel ratio is larger than 14.7 and a temperature of cooling water for the engine is higher than or equal to T (for example, 10° C.). Calculation of the target air-fuel ratio referred for change of the map is now described in detail. When the current air-fuel ratio map is the stoichiometric A/F map 103 and the target air-fuel ratio of the map value in the operating area defined by the reference Tp and the engine speed Ne is smaller than or equal to 14.7, the maps on the stoichiometric side are used as the maps for other control parameters such as the ignition map. Next, when the operating point is moved to change in an area where the target air-fuel ratio in the stoichiometric A/F map 103 is equal to 20, the map on the lean side is selected by the map changing logic 110 and accordingly at the same time when the target air-fuel ratio is retrieved in the lean A/F map 102, other parameters are changed to the map on the lean side. Further, when the load or the engine speed is increased during the lean operation and the operating point enters into an area where the air-fuel ratio is equal to 14.7 in the lean A/F map 102, the map is changed to the stoichiometric A/F map 103 and at the same time other parameters are also changed to the maps on the stoichiometric side.

The intake air amount Qa detected by an air flow sensor is supplied to a filter processing unit 111 in which noise is removed therefrom and the actual TPact is calculated in a block 112 in accordance with the equation 1. The actual TPact is used to update the reference TPref map 101 and also used as an axis of the stoichiometric learning map 113. Further, the target TPtar is calculated from the reference TPref as shown by the following equation 3 and the feedback control of an air amount control unit is performed by a difference between the actual TPact and the target TPtar.

$$\text{Target TPtar} = \text{Reference TPref} \times (\text{Target A/F})/14.7 \quad (3)$$

In the equation 3, the reference TPref is equivalent to an injection time in the stoichiometric operation and accordingly when the target air-fuel ratio is 14.7 in the stoichiometric operation, the target TPtar, the reference TPref and the actual TPact in the stoichiometric operation are equal to one another.

On the other hand, when the target air-fuel ratio is lean, for example 40, and an air amount control actuator (for example, an electronic controlled throttle) is controlled so that the target Tp becomes equal to the reference TPref multiplied by 40/14.7.

When the proportional-plus-derivative (PD) control of the throttle is made on the basis of a difference obtained by subtracting the actual TPact from the target TPtar, the difference is multiplied by a proportional gain Kp in a block 116 and a differentiated signal of a differentiator of a block 114 is multiplied by a differential gain Kd in a block 115 to produce a target throttle opening, which is supplied to a throttle control module (TCM) of the air amount control actuator.

On the other hand, with respect to the fuel, an injector opening valve delay time Ts is added to the reference TPref to calculate a fuel injection amount Ti.

Figure 2:
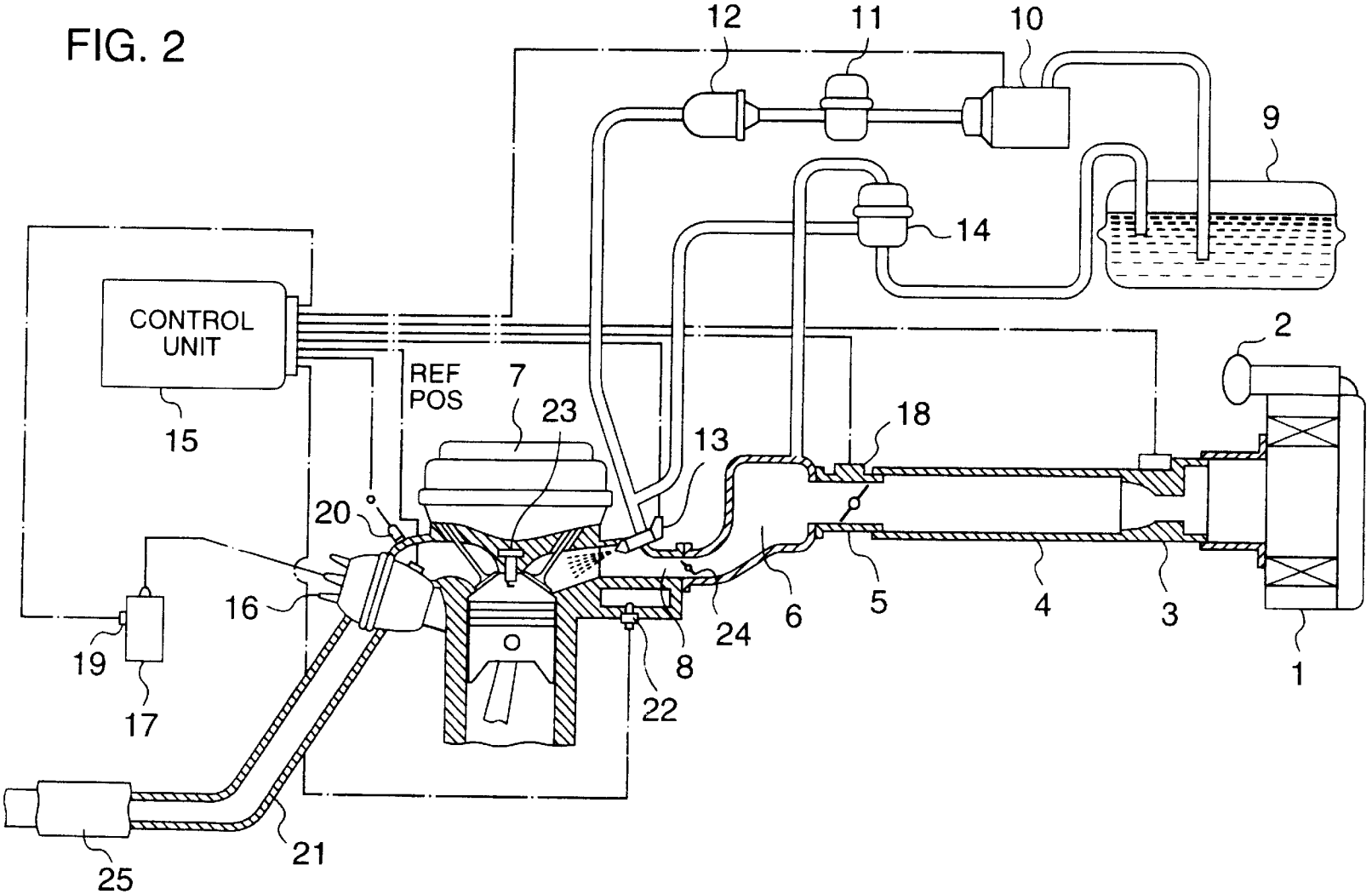
FIG. 2 illustrates an example of an engine system to which the present invention is applied.

Referring now to FIG. 2, an example of the engine system to which the present invention is applied is described. In FIG. 2, air to be sucked into the engine is taken from an inlet 2 of an air cleaner 1 and is fed through an air flow meter 3 and a throttle body including a throttle valve 5 for controlling an intake air amount to a collector 6.

The sucked air is distributed into intake pipes connected to cylinders of the engine 7 and introduced into the cylinders.

On the other hand, fuel such as gasoline is fed from a fuel tank 9 and pressurized by a fuel pump 10. The pressurized fuel is supplied to a fuel system including a fuel damper 11, a fuel filter 12, a fuel injection valve (injector) 13 and a fuel pressure regulator 14 connected to one another through piping. The fuel is regulated to a fixed pressure by the regulator 14 and is injected from the injectors 13 provided in the intake pipes 8 of the cylinders 8 into the intake pipes 8.

Further, the air flow meter 3 produces a signal representative of an intake air amount and supplies the signal to a control unit 15.

In addition, a throttle sensor 8 for detecting the opening of the throttle valve 5 is disposed in the throttle body and an output thereof is also supplied to the control unit 15.

The reference numeral 24 denotes a swirl control valve which produces a swirl of intake air flow into the cylinder. The opening angle of swirl control valve 24 is controlled by the control unit 15. In the stoichiometric A/F mixture condition, the swirl control valve 24 is fully opened and no swirl is produced. In the lean A/F mixture condition, the swirl control valve 24 chokes the air passage to increase the speed of the air flow sucked into the cylinder thereby to produce the swirl of the mixture in the combustion chamber. A stable combustion can be obtained by the swirl of the lean mixture.

Numeral 16 denotes a distributor including a crank angle sensor and which produces a reference angle signal REF representative of a rotation angle of the crank shaft and an angle signal POS for detection of a rotation signal (rotational number), which are also supplied to the control unit 15.

Numeral 20 denotes an air-fuel ratio (A/F) sensor disposed in an exhaust pipe and which supplies an output signal thereof to the control unit 15. The sensor detects an air-fuel ratio of mixture in the actual operation and may be a type that a linear output is produced in accordance with the detected air-fuel ratio or a type that whether the detected air-fuel ratio is rich or lean as compared with a predetermined air-fuel ratio is detected. A catalyst converter 25 is disposed on the way of the exhaust pipe to purify CO, HC and NOx contained in the exhaust gas.

Figure 3:
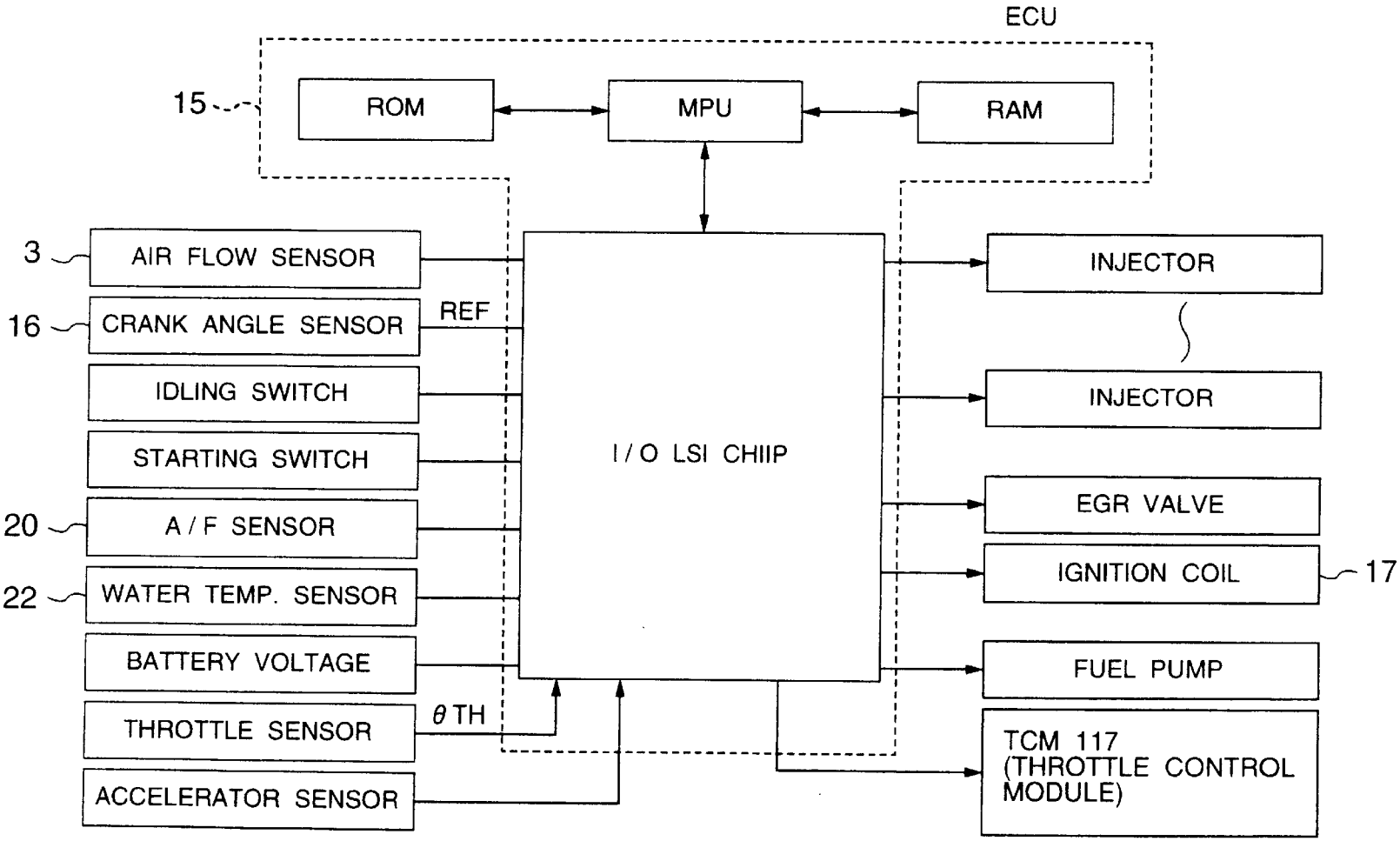
FIG. 3 is a schematic diagram illustrating a control unit to which the present invention is applied.

The control unit 15 mainly includes, as shown in FIG. 3, an MPU, a ROM and analog-to-digital (A/D) converters and is supplied with signals from various sensors for detecting operation states of the engine. The control unit 15 performs a predetermined operation process for the signals to produce various control signals calculated as the operation result. The control unit supplies predetermined control signals to the injector 13 and the ignition coil 17 to perform fuel supply amount control and ignition timing control.

Figure 4:
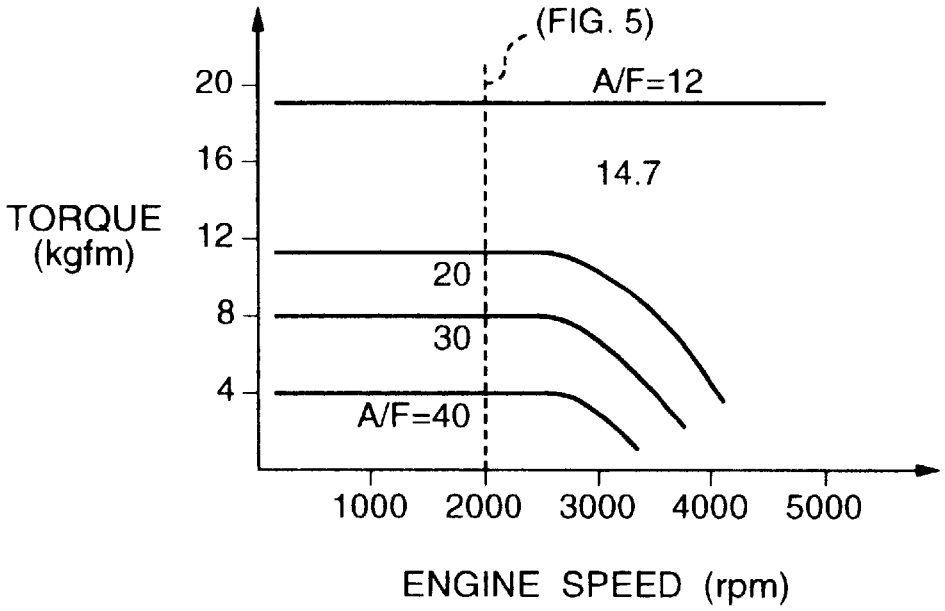
FIG. 4 shows an example of setting of a target air-fuel ratio.
Figure 5:
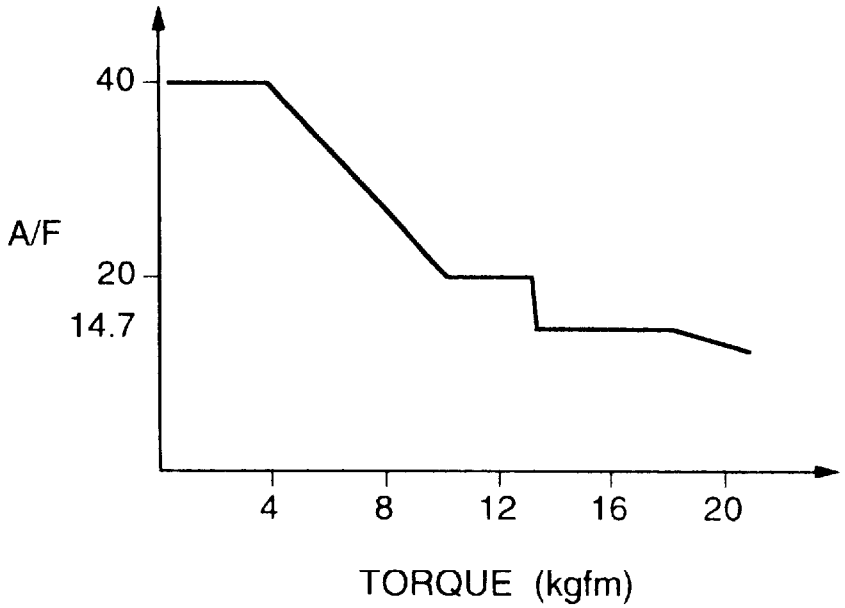
FIG. 5 shows an example of setting of a target air-fuel ratio for torque.
Figure 6:
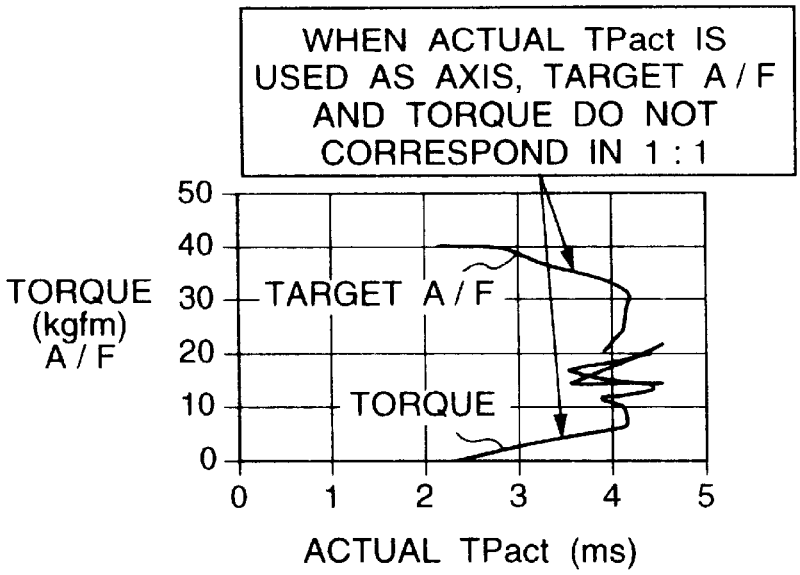
FIG. 6 shows an example of setting of a target air-fuel ratio (A/F) in the lean burn engine.

FIG. 4 shows an example of a map in which the target air-fuel ratios (A/F) in the lean burn engine are plotted for the engine speed Ne and the torque defined as axes. The map shows a pattern in which the air-fuel ratio is set to be lean as the load is light. FIG. 5 shows a graph obtained by rewriting the map of FIG. 4 with regard to a certain engine speed (2,000 rpm). In FIG. 5, the abscissa defines torque. FIG. 6 shows the relation of FIG. 5 with the abscissa defining a basic fuel injection pulse width TPbas (actual TPact) of a parameter capable of being actually detected in the engine control unit. In this case, since the plurality of target air-fuel ratios correspond to one value of the actual TPact and the torque does not also correspond to the actual TPact in one-to-one manner, it is impossible to retrieve the target air-fuel ratio while using the actual TPact as an axis and cause the operating point to correspond to the target air-fuel ratio in one-to-one manner.

Figure 7:
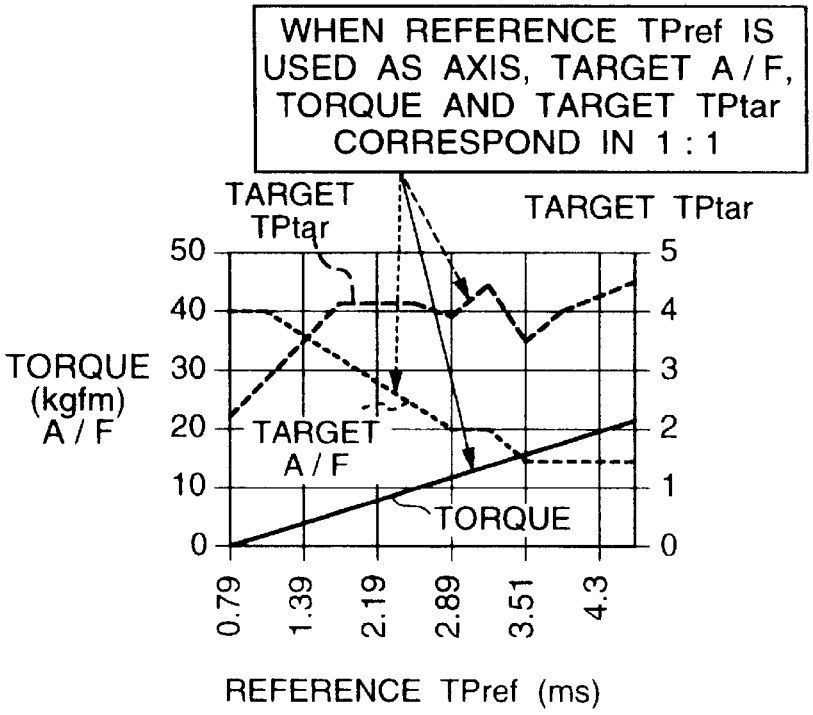
FIG. 7 shows an example of setting of a target air-fuel ratio in an embodiment of the present invention.

FIG. 7 shows a rearranged graph of the relation of FIG. 5 applied to the control system of FIG. 1 characterizing the present invention with the abscissa defined by the reference TPref. It is understood from FIG. 7 that the torque and the target air-fuel ratio (A/F) correspond to the reference TPref in one-to-one manner and FIG. 7 can be used as a practical map. Further, the target Tp which is not added to be inputted to the block 116 of FIG. 1 corresponds to a value if the reference Tp is determined.

FIGS. 4 to 7 show the study of the control axis on the basis of an example for setting of the air-fuel ratio and the effectiveness of the control axis is verified in FIG. 8 quantitatively in order to calculate a general solution.

In FIG. 8, target air-fuel ratios are assigned to each of three torque conditions, and FIG. 8 shows the relation of the actual TPact when the engine is operated in the lean condition actually. Numerical values in brackets [ ] represent actual values. Three different torque points T1 [8 kgfm], T2 [10 kgfm] and T3 [12 kgfm] are set for the same engine speed. When TP for the three points in the stoichiometric operation or the reference TPref are assumed to be Tp1, Tp2 and Tp3, the relation of Tp1<Tp2<Tp3 are effected. A ratio of TP at this time (Tp2/Tp1) is assumed to a.

Next, the target air-fuel ratios (A/F) are set to be A/F1, A/F2 and A/F3 so that the inclination of the air-fuel ratios is reduced between T1 and T2 and between T2 and T3 as shown by the set pattern 2 of the air-fuel ratio (A/F) of FIG. 8. The ratio of the air-fuel ratios of (A/F2)/(A/F1) is assumed to be b. At this time, the actual Tp has the relation of LTp1<LTp2<LTp3 and is increased monotonously with respect to the torque. Accordingly, the torque and the actual TPact have the relation of 1 to 1 and even when the actual TPact is used as the control axis, the air-fuel ratio can be set. A product a×b of the above-mentioned a and b has a numerical value larger than or equal to 1 between T1 and T2 and between T2 and T3.

However, the target air-fuel ratios are set to be A/F1, A/F2 and A/F3 so that the inclination of the air-fuel ratio is increased between T1 and T2 and between T2 and T3 as shown by the set pattern 1 of the air-fuel ratio of FIG. 8. The ratio b of the air-fuel ratios at this time is smaller than the set pattern 2 of the air-fuel ratio. Further, the actual Tp at this time has the relation of LTp1<LTp2>LTp3 and the actual TPact is reduced between T2 and T3 although the torque is increased therebetween. Accordingly, the torque and the actual TPact do not have the relation of 1 to 1 and when the actual TPact is used as the control axis, the air-fuel ratio cannot be set. In this case, the product a×b is smaller than or equal to 1 between T2 and T3.

When the results obtained from the above study are arranged quantitatively, the target air-fuel ratio can correspond with the actual TPact axis in one-to-one manner in the setting that the inclination of the air-fuel ratio to the torque is small so that the product a×b is larger than or equal to 1, while the target air-fuel ratio cannot correspond with the actual TPact axis in the setting that the inclination of the air-fuel ratio to the torque is larger so that the product a×b is smaller than or equal to 1.

Accordingly, when any two operating points having equal engine speeds Ne and different torques (T1<T2) are selected from the operating points of the engine and the air-fuel ratio is set so that a×b<1, the control parameters such as the accelerator operating (depressing) amount, the ignition timing, the air-fuel ratio, the fuel injection timing and the EGR rate are selected and accordingly if there is provided means for retrieving a map for the control parameters having one axis in which the engine speed is defined and the other axis in which any of the accelerator operating amount or the reference TPref which is a function of the accelerator operating amount is defined, the limitation for the setting of the air-fuel ratio is removed and the dynamic range of the used air-fuel ratio can be widened.

Figure 9:
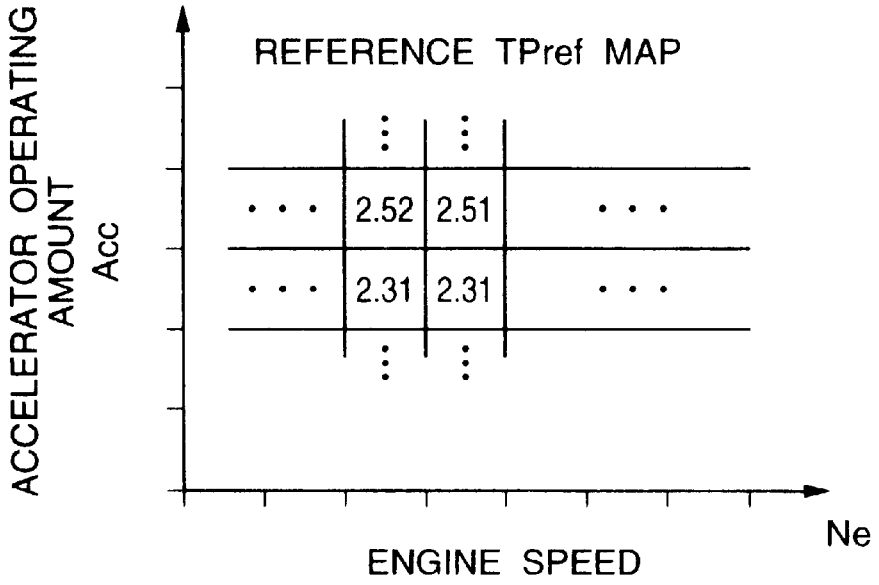
FIG. 9 shows a reference TPref map used in the embodiment of the present invention.

FIG. 9 shows the map which corresponds to the contents of the reference TPref map of FIG. 1 and is retrieved by two axes of the accelerator operating amount and the engine speed Ne. The map of FIG. 9 is stored in a ROM.

Figure 10:
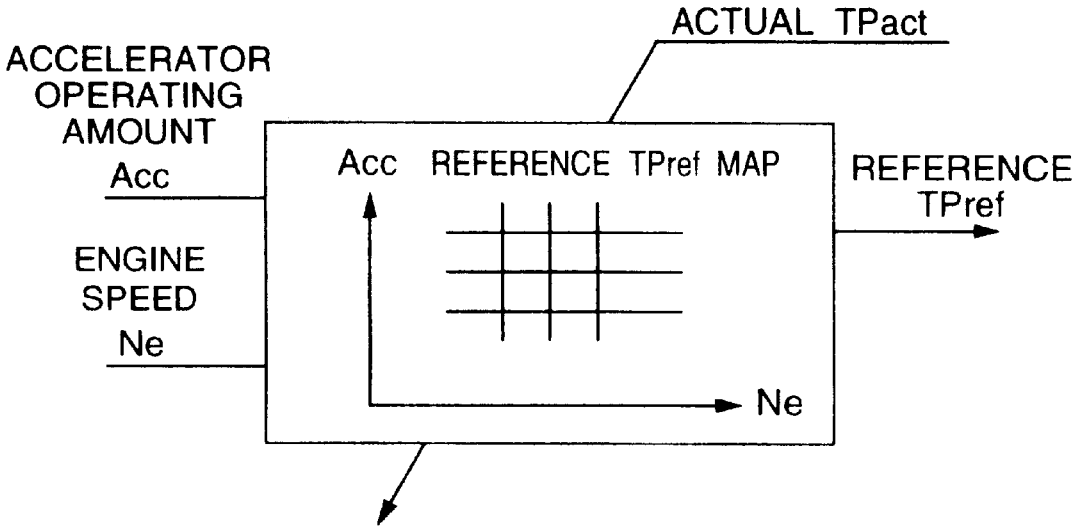
FIG. 10 is a block diagram of the reference TPref map used in the embodiment of the present invention.

FIG. 10 is a block diagram showing the reference Tp map of FIG. 9, which is supplied with the accelerator operating amount Acc and the engine speed Ne and produces the reference TPref. Further, values in the reference TPref map can be corrected by the actual TPact upon the stoichiometric operation.

Figure 13:
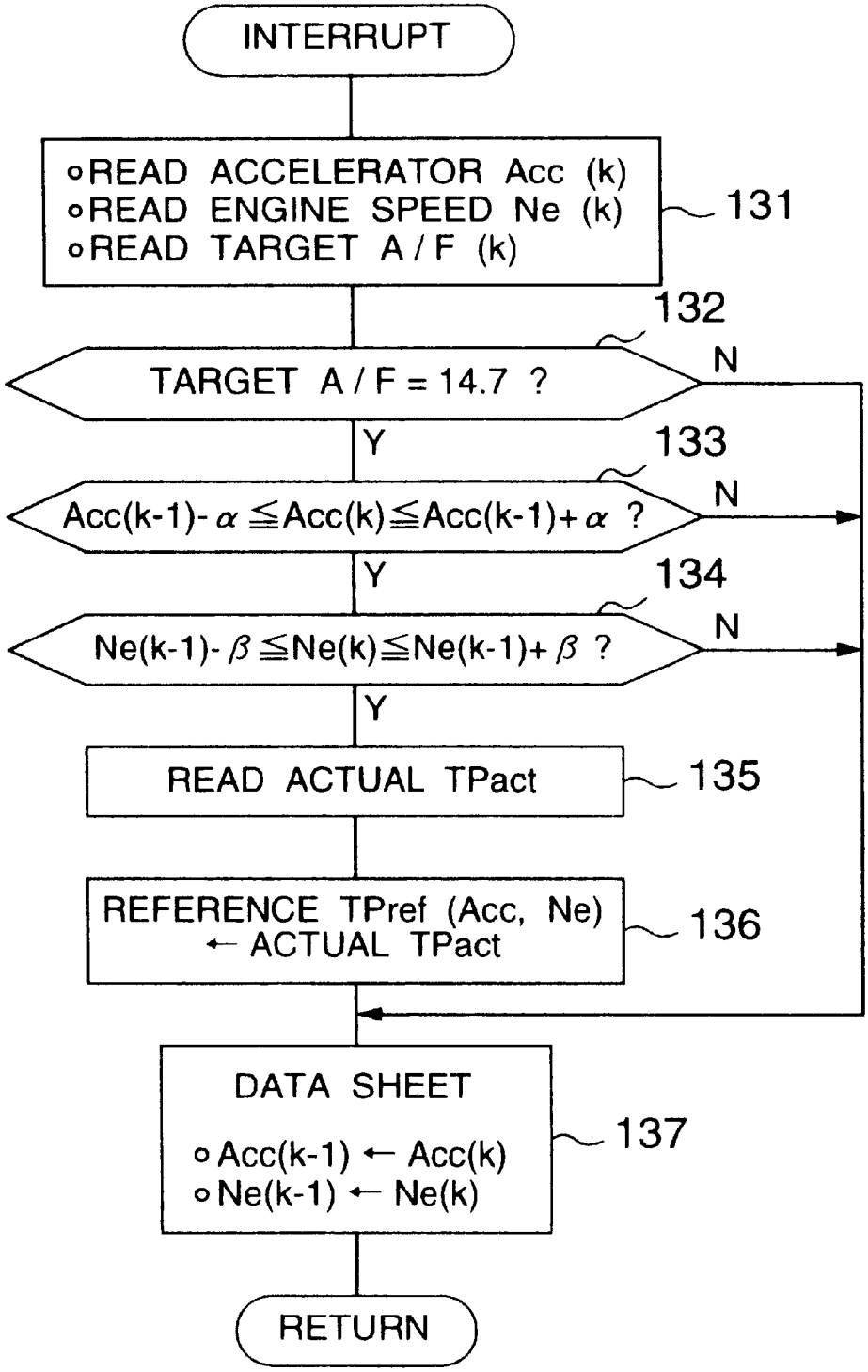
FIG. 13 is a flow chart showing a control operation of a control apparatus according to an embodiment of the present invention.

The correction of the reference TPref map is processed as shown in a flow chart of FIG. 13. A series of processes of FIG. 13 is performed in response to an interrupt occurring at intervals of fixed time and in block 131 an accelerator operating amount Acc (k), an engine speed Ne (k) and a target air-fuel ratio at the current time are read. In decision 132, whether the target air-fuel ratio is 14.7 or not is judged. If the current target air-fuel ratio is 14.7, that is, stoichiometric, the process proceeds to decision 133. In two decisions 133 and 134, whether the engine is in the normal state or not is judged. First, in decision 133, whether a difference between the current accelerator operating amount Acc (k) and the last accelerator operating amount (k−1) is within a fixed value of ±α or not is judged. In decision 134, whether a difference between the current engine speed Ne (k) and the last engine speed Ne (k−1) is within a fixed value of ±β or not is judged. In the above decisions, if it is judged that the engine is in the normal state, the actual TPact is read in block 135. Further, in block 136, a value of the reference TPref in an area determined by the accelerator operating amount and the engine speed is updated by the actual TPact value. Then, in block 137, the accelerator operating amount Acc (k−1) and the engine speed Ne (k−1) are updated by the respective current values for the next process. The actual TPact map is updated as above.

Figures 11, 12:
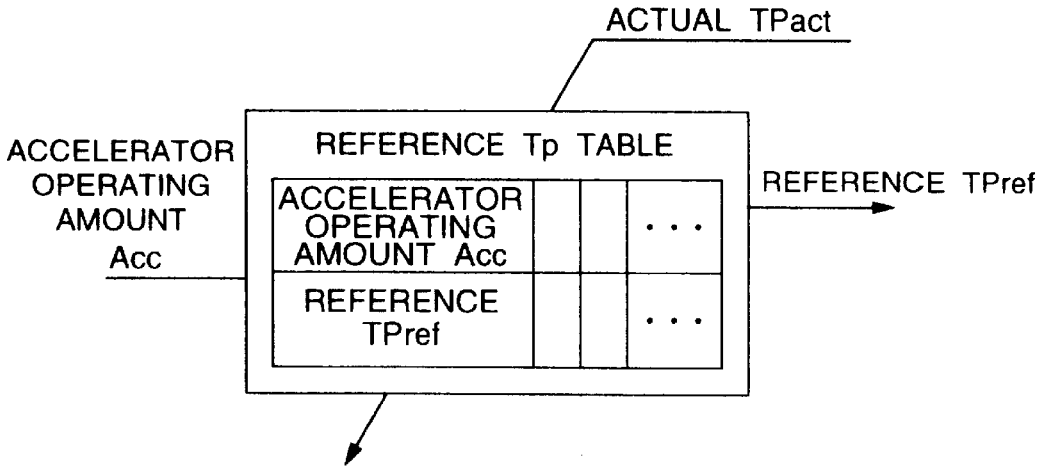
FIG. 11 shows a reference TPref table used in the embodiment of the present invention.
FIG. 12 is a block diagram of the reference TPref table used in the embodiment of the present invention.

FIG. 11 shows a reference TPref table in which a factor of the engine speed is removed in the map of FIG. 9.

FIG. 12 is a block diagram of the reference Tp table portion of FIG. 11, which is supplied with the accelerator operating amount Acc and produces the reference TPref. Values of the reference TPref table can be corrected by the actual TPact upon the stoichiometric operation as described in the flow chart of FIG. 13 in the same manner as the reference TPref map.

Figure 14:
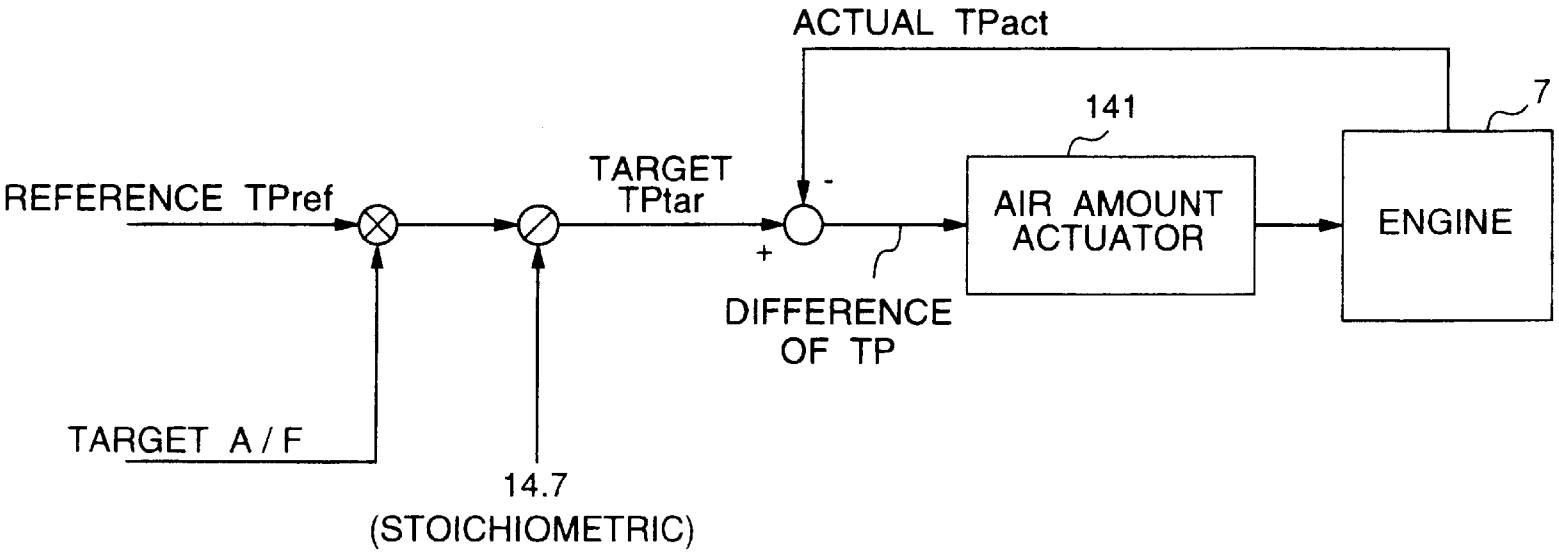
FIG. 14 is a block diagram schematically illustrating an air amount control unit according to the embodiment of the present invention.

A block diagram of FIG. 14 illustrates a control portion for controlling an air amount on the basis of the target TPtar. The target TPtar is calculated by multiplying the reference TPref by the target air-fuel ratio and dividing its product by the air-fuel ratio=14.7 in the stoichiometric operation as described in the equation 3. An air amount actuator 141 operates to increase the intake air amount Qa when the reference TPref is larger than the actual TPact (reference TPref>actual TPact) and to reduce the intake air amount Qa when the reference TPref is smaller than the actual TPact (reference TPref<actual TPact) on the basis of a difference between the target TPtar and the actual TPact calculated as described by the equation 1. The air amount control actuator 141 may be an electronic control throttle driven by a motor, for example.

Figure 15:
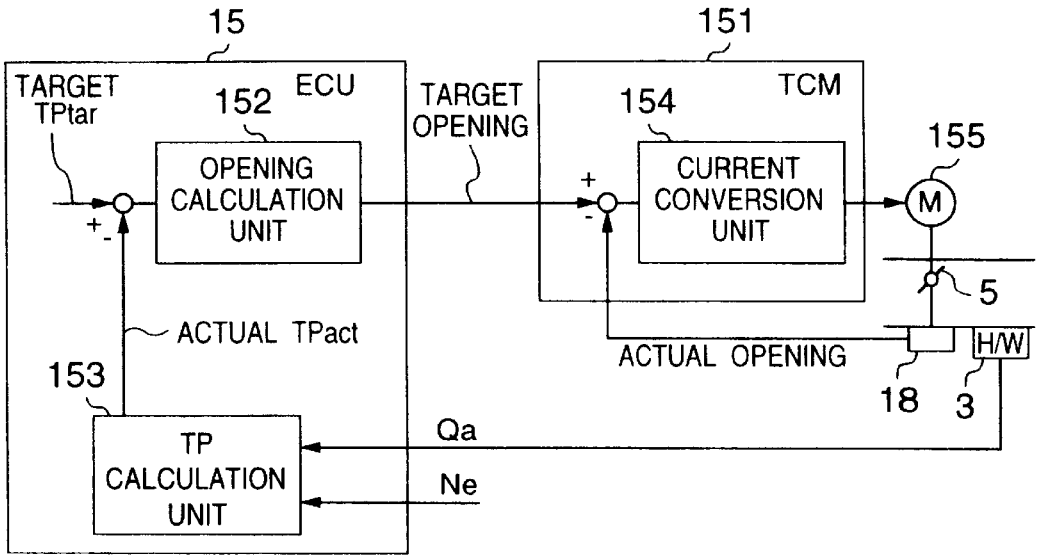
FIG. 15 schematically illustrates an example of the input/output relation of a control unit to which the present invention is applied.

FIG. 15 shows the input and output relation of signals of a control unit 15 and a throttle control module TCM 151 constituting an example of the air amount actuator 141 of FIG. 14. A Tp calculation unit of the control unit 15 is supplied with the intake air amount Qa measured by the intake air flow meter 3 and the engine speed Ne and produces the actual TPact. The actual TPact is compared with the target TPtar as shown in FIG. 14 and the difference thereof is supplied to an opening calculation unit 152. The opening calculation unit 152 calculates a target opening of the electronic control throttle on the basis of the difference between the target TPtar and the actual TPact. The TCM compares the target opening sent from the control unit 15 with an actual opening detected by a throttle sensor 18 and supplies a difference of the opening to a current conversion unit 154. The current conversion unit 154 calculates a current supplied to a motor 155 on the basis of the difference of the opening and controls the current to the motor 155. Torque from a shaft of the motor 155 is transmitted through a gear to a throttle valve 5 so that the feedback control is performed to attain the target opening and the target TPtar.

Figure 16:
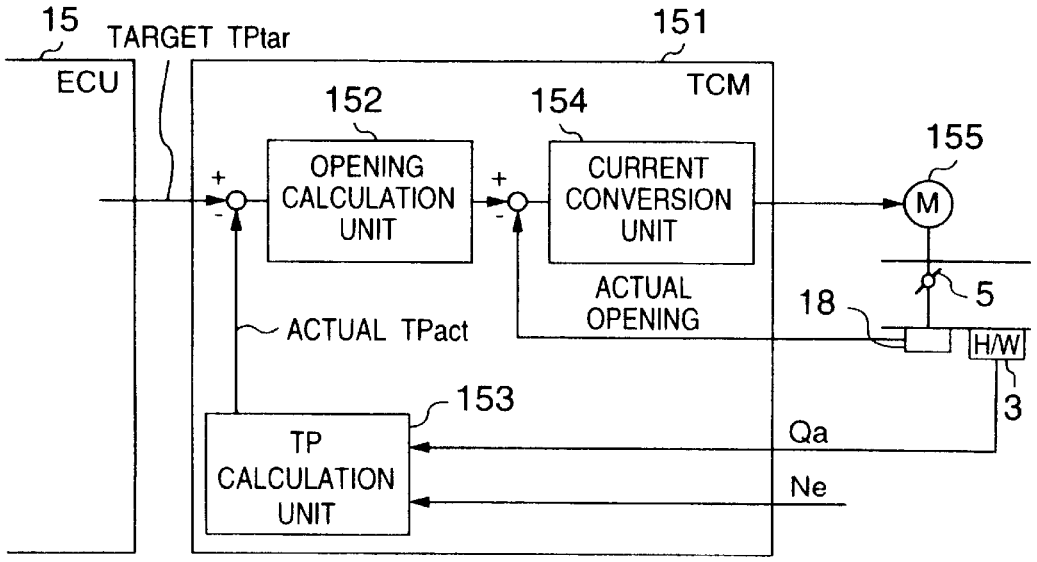
FIG. 16 schematically illustrates an example of the input/output relation of a control unit to which the present invention is applied.

FIG. 16 shows the input and output relation of signals of the control unit 15 and the throttle control module TCM 151 constituting an example of the air amount actuator 141 shown in FIG. 14. FIG. 16 shows an example different from FIG. 15 in that the TP (injection time) calculation unit 153 and the opening conversion unit 152 are incorporated into the TCM 151. Accordingly, the control unit 15 sends the target TPtar to the TCM 151. In the TCM 151, the Tp calculation unit 153 are supplied with the intake air amount Qa measured by the intake air flow meter 3 and the engine speed Ne and produces the actual TPact. The actual TPact is compared with the target TPtar and a difference therebetween is supplied to the opening calculation unit 152. The opening calculation unit 152 calculates the target opening of the electronic control throttle on the basis of the difference of the TP. Then, the target opening is compared with the actual opening detected by the throttle sensor 18 and a difference of the opening is supplied to the current conversion unit 154. The current conversion unit 154 calculates the current supplied to the motor 155 on the basis of the difference of the opening to control the current to the motor 155. The torque from the shaft of the motor 155 is transmitted through the gear to the throttle valve 5 so that the feedback control is performed to attain the target opening and the target TPtar.

Figure 17:
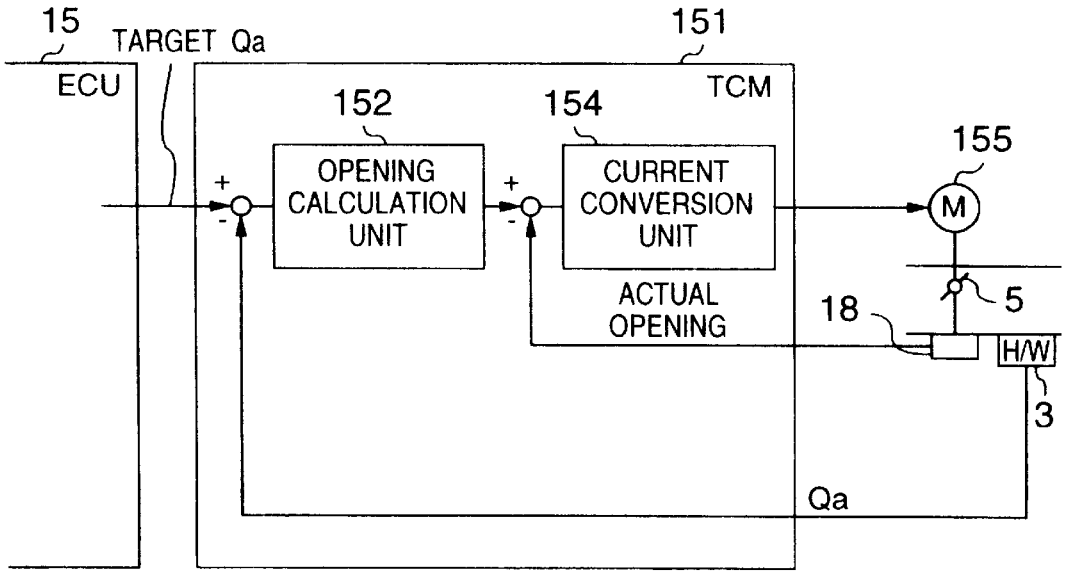
FIG. 17 schematically illustrates an example of the input/output relation of a control unit to which the present invention is applied.

FIG. 17 shows the input and output relation of signals of the TCM (Throttle Control Module) 151 constituting an example of the air amount actuator 141 and the control unit 15. FIG. 17 shows an example different from FIGS. 15 and 16 in that the signal sent from the control unit 15 to the TCM 151 is the target intake air amount Qa. With this communication configuration, the TCM 151 compares the target intake air amount Qa with the actual intake air amount Qa to perform the feedback control. A difference between the target intake air amount Qa and the actual intake air amount Qa is supplied to the opening calculation unit 152. The opening calculation unit 152 calculates the target opening of the electronic control throttle on the basis of the difference of Qa. Then, the target opening is compared with the actual opening detected by the throttle sensor 18 and a difference of the opening is supplied to the current conversion unit 154. The current conversion unit 154 calculates the current supplied to the motor 155 on the basis of the difference of the opening to control the current to the motor 155. The torque from the shaft of the motor 155 is transmitted through the gear to the throttle valve 5 so that the feedback control is performed to attain the target opening and the target Qa.

Figure 18:
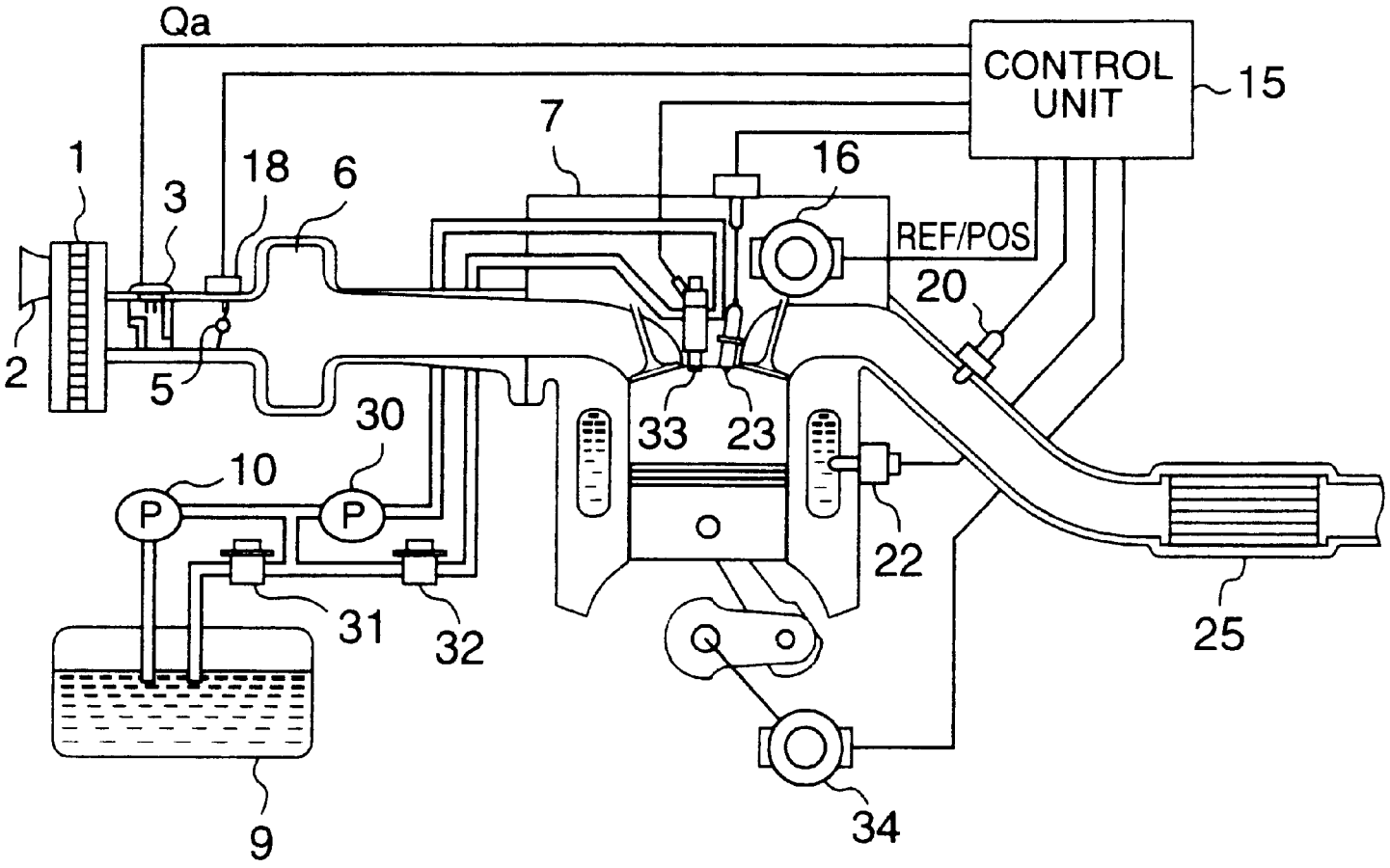
FIG. 18 illustrates an example of an engine system to which the present invention is applied.

The present invention is effective for the engine system which performs the lean combustion and particularly the present invention is very effective for the lean burn engine having a wide dynamic range of the air-fuel ratio. FIG. 18 illustrates a definite structure of an inner-cylinder injection engine system which directly injects fuel into a combustion chamber as an example of the lean burn engine having the wide dynamic range of the air-fuel ratio. A difference between the engine system of FIG. 18 and the port injection engine system of FIG. 2 is now described.

Fuel such as gasoline is fed from a fuel tank 9 and primarily pressurized by a fuel pump 10. Further, the pressurized fuel by the pump 10 is secondarily pressurized by a fuel pump 30 and is supplied to a fuel system in which an injector 13 is disposed. The primarily pressurized fuel is controlled to a fixed pressure (for example, 3 $kg/cm^2$) by a fuel pressure regulator 31. The fuel secondarily pressurized to a higher pressure is controlled to a fixed pressure (for example, 30 $kg/ch^2$) by a fuel pressure regulator 32. Both the fuels are injected from high-pressure injectors 33 provided in each cylinder into cylinders.

Numeral 16 denotes a crank angle sensor attached to a cam shaft and which produces a reference angle signal REF representative of a rotation position of the crank shaft and an angle signal POS for detection of a rotation signal (engine speed) and supplies these signals to the control unit 15. The crank angle sensor may be a type of directly detecting the rotation of the crank shaft as 34.

Numeral 20 denotes an air-fuel ratio (A/F) sensor disposed in an exhaust pipe and which supplies an output signal to the control unit 15.

In the present invention, since the accelerator operating amount is inputted to calculate the reference TPref so that the throttle opening is controlled, an important subject in the air-fuel ratio control and the torque control is to ensure the accuracy of the accelerator operating amount and the throttle opening. Particularly, in the vicinity of the completely closed state of the throttle in which an increasing rate of the intake air amount to the throttle opening is large, it is necessary to ensure the measurement accuracy of the accelerator operating amount and the throttle opening.

Figure 19:
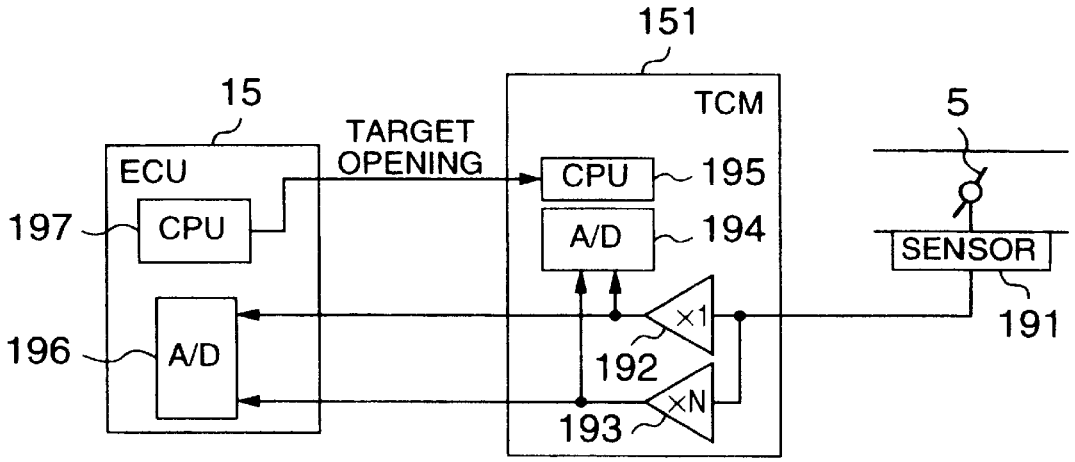
FIG. 19 schematically illustrates an example of the input/output relation of a control unit to which the present invention is applied.
Figure 20:
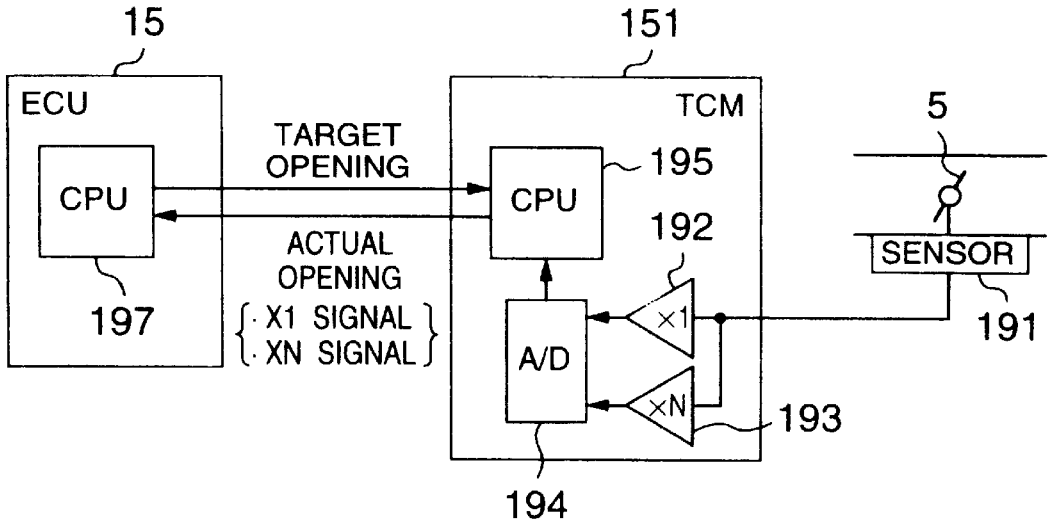
FIG. 20 schematically illustrates an example of the input/output relation of a control unit to which the present invention is applied.

FIGS. 19 and 20 illustrate the configuration in which the accelerator operating amount and the throttle opening are inputted to the control unit 15 with high accuracy.

The TCM 151 of FIG. 19 includes an amplifier 192 having a gain of one time and an amplifier 193 for amplifying a voltage from a throttle opening sensor 191 or/and an accelerator operating amount signal by N (N is any positive number larger than 1) times. Outputs of the amplifiers 192 and 193 are converted into digital signals by an analog-to-digital (A/D) converter 194 and inputted to a CPU 195. The CPU 195 selects any one of the one-time signal and the N-time signal. In a small throttle opening, the CPU 195 uses the N-time signal from the amplifier 193 in order to cause the actual opening to follow the target opening exactly. The output signals of the amplifiers 192 and 193 are inputted to an analog-to-digital (A/D) converter 196 in the control unit 15 to be converted into digital signals and are supplied to a CPU 197. In this manner, since the control unit 15 can also obtain the N-time signal, calculation of the reference TPref and control of the throttle in the small opening can be performed with high accuracy.

FIG. 20 illustrates an example having the same object as FIG. 19 and a different configuration. The TCM 151 includes the amplifier 192 having a gain of one time and the amplifier 193 for amplifying a voltage from the throttle opening sensor 191 or/and the accelerator by N times. Outputs of the amplifiers 192 and 193 are converted into digital signals by an analog-to-digital (A/D) converter 194 and supplied to CPU 195. The CPU 195 selects any one of the one-time signal or the N-time signal and the CPU 195 uses the N-time signal from the amplifier 193 in the small opening operation in order to cause the actual opening to follow the target opening exactly. The CPU 195 of the TCM communicates with the CPU 197 of the control unit 15 to send the digital data of the one-time signal and the N-time signal of the actual opening to the CPU 197. In this manner, the control unit 15 can also obtain the N-time signal and calculation of the reference TPref and control of the throttle in the small opening can be performed with high accuracy.

In the prior art, since the actual TPact is used as an axis on the side of load, the actual TPact is not uniquely determined with respect to torque in the lean combustion and there is a phenomenon that the actual TPact is reversed when the load is heavy.

According to the present invention, however, since the reference Tp is used as an axis, the torque, the reference Tp and the target air-fuel ratio (A/F) have the uniquely determined relation, so that the set range of the target air-fuel ratio can be increased in the lean combustion area and the engine can be operated with the optimum air-fuel ratio in accordance with the load. Similarly, the engine can be operated with the optimum ignition timing, fuel injection timing and EGR rate in accordance with the load.

According to the present invention, since the control parameters are retrieved by using the engine speed Ne and the reference Tp as axes when the operating point of the engine is set, the relation determined uniquely for the target air-fuel ratio (A/F), the target TPtar and the control parameters for torque can be prepared. Thus, since the large degree of freedom is provided in setting of the target air-fuel ratio, the optimum air-fuel ratio and the control parameters can be set in accordance with the load in the lean combustion area so that the stable lean combustion can be attained.

What is claimed is:

1. A lean burn engine control apparatus in an electronic engine control system for a lean burn engine including means for detecting an amount (Qa) of intake air fed into a cylinder of the engine, means for detecting an engine speed (Ne), means for calculating a basic fuel injection pulse width (TPbas) on the basis of said intake air amount (Qa) and said engine speed (Ne), and means for determining control parameters containing any of at least an air-fuel ratio, an ignition timing, a fuel injection timing, a throttle opening and an EGR rate in accordance with an operating state of the engine in optimum, said lean burn engine control apparatus comprising:

means for determining a reference injection pulse width (TPref) having the same dimension as said basic fuel injection pulse width (TPbas) and which is a function of an accelerator operating amount determined on the basis of the accelerator operating amount as a load parameter used upon determination of the control parameters of the engine in operation with a lean air-fuel ratio.

2. A lean burn engine control apparatus according to claim 1, wherein said control parameters include at least one of the air-fuel ratio, the ignition timing, a fuel injection start timing, a fuel injection completion timing, the EGR rate and the strength of swirl flow in a cylinder.

3. A lean burn engine control apparatus according to claim 1, wherein an injector for injecting fuel comprises an inner-cylinder injector for directly injecting fuel into a cylinder.

4. A lean burn engine control apparatus in an electronic engine control system for a lean burn engine including means for detecting an amount (Qa) of intake air fed into a cylinder of the engine, means for detecting an engine speed (Ne), means for calculating a basic fuel injection pulse width (TPbas) per cylinder by dividing said intake air amount (Qa) by said engine speed (Ne) and multiplying a quotient of said division by a coefficient so that an air-fuel ratio is equal to a stoichiometric air-fuel ratio, and means for retrieving a map for control parameters for selecting the control parameters containing any of at least the air-fuel ratio, an ignition timing, a fuel injection timing, a throttle opening and an EGR rate in optimum in accordance with an operating state of the engine with an axis for said engine speed and an axis for an engine load, said lean burn engine control apparatus comprising:

means for retrieving the control parameters by using said basic fuel injection pulse width (Tpbas) as an axis representative of the engine load in operation with a theoretical air-fuel ratio; and means for retrieving the control parameters by using a reference injection pulse width (TPref) having the same dimension as said basic pulse width (TPbas) and which is a function of an accelerator operating amount as an axis representative of the engine load in operation with a lean air-fuel ratio.

5. A lean burn engine control apparatus according to claim 4, wherein said control parameter is retrieved by using said basic fuel injection pulse width (TPbas) as an axis on the side of an engine load in the theoretical air-fuel ratio and said control parameter is retrieved by using a variable other than said basic fuel injection pulse width (TPbas) as the axis representing the engine load in the lean air-fuel ratio.

6. A lean burn engine control apparatus according to claim 4, comprising means for storing an air-fuel ratio map for lean combustion and an air-fuel ratio map for a stoichiometric air-fuel ratio set from said reference (TPref) and said engine speed.

7. A lean burn engine control apparatus according to claim 4, comprising means for storing an ignition timing map for lean combustion and an ignition timing map for an ideal air-fuel ratio set from said reference (TPref) and said engine speed.

8. A lean burn engine control apparatus according to claim 4, comprising means for storing an injection timing map for lean combustion and an injection timing map for a stoichiometric air-fuel ratio set from said reference (TPref) and said engine speed.

9. A lean burn engine control apparatus according to claim 4, comprising means for storing an EGR rate map for lean combustion and an EGR rate map for a stoichiometric air-fuel ratio set from said reference (TPref) and said engine speed.

10. A lean burn engine control apparatus according to claim 6, wherein said map is changed to various maps for lean combustion containing at least the air-fuel ratio map for lean combustion when the conditions that the target air-fuel ratio is larger than 14.7 and a temperature of cooling water for the engine is larger than 10° are satisfied.

11. A lean burn engine control apparatus according to claim 4, wherein said reference (TPref) is a variable retrieved in the map having an axis for the engine speed and an axis for the accelerator operating amount.

12. A lean burn engine control apparatus according to claim 11, comprising learning means for updating said map for reference (TPref) so that the reference (TPref) in an operating area determined by the engine speed and the accelerator operating amount is coincident with the basic fuel injection pulse width (TPbas) in a stoichiometric air-fuel ratio.

13. A lean burn engine control apparatus according to claim 12, wherein in a learning condition, an air-fuel ratio is a stoichiometric air-fuel ratio and a feedback condition is performed.

14. A lean burn engine control apparatus according to claim 4, wherein said reference (TPref) is a variable retrieved in a table having an axis for the accelerator operating amount.

15. A lean burn engine control apparatus according to claim 14, comprising means for updating the table for the reference (TPref) so that the reference (TPref) determined by the accelerator operating amount is coincident with the basic fuel injection pulse width (TPbas) in the stoichiometric air-fuel ratio.

16. A lean burn engine control apparatus according to claim 4, wherein a value obtained by multiplying the reference (TPref) by a target air-fuel ratio and dividing a product of the multiplication by the stoichiometric air fuel ratio is set as a target fuel injection amount (TPtar) and the intake air amount is subjected to feedback control so that an actual fuel injection amount (TPact) calculated from the intake air amount (Qa) and the engine speed (Ne) follows the target fuel injection amount (TPtar).

17. A lean burn engine control apparatus according to claim 16, wherein an actuator for controlling the intake air amount is an electronic control throttle.

18. A lean burn engine control apparatus according to claim 17, wherein said engine control apparatus sends the target fuel injection amount (TPtar) to a throttle control apparatus and said throttle control apparatus controls a throttle opening so that the actual fuel injection amount (TPact) follows the target fuel injection amount (TPtar).

19. A lean burn engine control apparatus according to claim 17, wherein said engine control apparatus sends a target intake air (Qa) to a throttle control apparatus and said throttle control apparatus controls a throttle opening so that an actual intake air (Qa) follows the target intake air amount (Qa).

20. A lean burn engine control apparatus comprising:

means for retrieving a map for each control parameter having one axis in which an engine speed is defined and the other axis in which any of an accelerator operating amount and a reference injection pulse width (TPref) which is a function of said accelerator operating amount is defined, so as to select the control parameter containing any of at least an accelerator opening, an ignition timing, an air-fuel ratio, a fuel injection timing and an EGR rate, when A/F is set to be $a \times b < 1$, that is, when a changing rate of A/F is made larger than a predetermined value in the setting that A/F is made lean as torque is small where a is a changing rate from Tp1 to Tp2 in which a=Tp2/Tp1 and b is a changing rate from A/F1 to A/F2 in which b=(A/F2)/(A/F1) where Tp1, A/F1 and T1 are a basic fuel injection amount in a theoretical air-fuel ratio, a target A/F and torque in one of any two operating points having the same engine speed (Ne) and different torque, with $T_2 > T_1$, selected from engine operating points, respectively, and Tp2, A/F2 and T2 are a basic fuel injection amount in an ideal air-fuel ratio, a target A/F and torque in the other of said two operating points, respectively.

* * * * *